US005500642A

United States Patent [19]

Battle

[11] Patent Number: 5,500,642

[45] Date of Patent: Mar. 19, 1996

[54] PROTECTIVE WARNING POST

[76] Inventor: Larry D. Battle, 36 Snow Meadow La., Stafford, Va. 22554

[21] Appl. No.: 254,511

[22] Filed: Jun. 6, 1994

[51] Int. Cl.[6] ..... B60Q 1/48

[52] U.S. Cl. ..... 340/932.2; 340/436; 340/665; 180/232; 200/61.41; 404/10; 404/11; 40/608; 116/203

[58] Field of Search ..... 340/932.2, 436, 340/437, 665, 666, 689, 692; 180/199, 232; 200/61.08, 61.45 R, 61.49, 61.41, 61.42, 61.43, 85 R; 40/608, 612; 404/10, 11; 116/203

[56] References Cited

U.S. PATENT DOCUMENTS

| | | | |
|---|---|---|---|
| 2,454,896 | 11/1948 | Traub . | |
| 2,658,967 | 11/1953 | Matschke, Jr. | 200/61.41 |
| 2,879,350 | 3/1959 | Howell | 200/61.41 |
| 3,478,311 | 11/1969 | Czingula | 340/932.2 |
| 4,237,446 | 12/1980 | Roberts | 340/436 |
| 4,288,777 | 9/1981 | Luik | 340/932.2 |
| 4,318,077 | 3/1982 | Bubnich et al. | 340/932.2 |
| 4,341,488 | 7/1982 | Ryan | 340/932.2 |
| 4,747,725 | 5/1988 | Gebelius | 40/608 |
| 5,210,528 | 5/1993 | Schulman et al. | 340/692 |
| 5,227,785 | 7/1993 | Gann et al. | 340/932.2 |

FOREIGN PATENT DOCUMENTS

| | | |
|---|---|---|
| 1026771 | 5/1953 | France . |
| 1391061 | 4/1975 | United Kingdom . |

*Primary Examiner*—Donnie L. Crosland
*Attorney, Agent, or Firm*—Richard C. Litman

[57] ABSTRACT

A protective post for guarding gasoline filling station pumps, drive up teller machines, and the like. The post has structural strength for resisting collision by a motor vehicle. It is hinged to its base by a stout spring. The post includes a rubber outer cover and an internal resilient layer, both surrounding a metal core member. Thus, the structure of the post both compresses resiliently and leans in response to contact by a motor vehicle. Both the guarded structure and the vehicle are spared damage by this construction. The warning post has contact actuated visible and audible alarms. Warning or commercial messages in the form of indicia may be located on the exterior surface.

6 Claims, 2 Drawing Sheets

PROTECTIVE WARNING POST

BACKGROUND OF THE INVENTION

1. Field of the Invention

The present invention relates to a guard protecting a delicate structure from impact by motor vehicles. The guard is in the form of a post secured to a driveway or curb located proximate the protected structure.

2. Description of the Prior Art

Protective barriers for protecting a delicate structure, such as a filling station pump, are known. These devices generally comprise a stout pipe, embedded in a concrete base, and reinforced, as by filling with concrete. These devices provide an unyielding barrier. This barrier protects its subject object, but at potential cost of severe damage to a motor vehicle.

French Pat. No. 1,026,771, dated May, 1953, discloses a traffic island for protecting pedestrians crossing busy roads. The traffic island has a protective post yieldingly stops a vehicle colliding with the post. The post is illuminated so that it will be conspicuous. There is no accommodation for protecting the vehicle, and no warning alarm in either the French reference, nor in the pipe type barriers discussed above.

Yielding reaction to impact is illustrated in U.S. Pat. No. 4,747,725, issued to Sven R. V. Gebelius on May 31, 1988, and U.K. Pat. No. 1,391,061, dated April, 1975. These patents show traffic indicating lights of the breakaway type. The device which is the subject of the U.K. reference includes a warning light which is activated upon separation of the light from its mooring. These inventions yield, but break away in so doing, and consequently will not protect an object from impact. They also lack warnings which operate upon light contact.

A vertically oriented warning device which illuminates a lamp upon contact is seen in U.S. Pat. No. 5,227,785, issued to William S. Gann on Jul. 13, 1993. This device lacks the strength to resist impact, being intended for use in executing slow, deliberate parking maneuvers. It also lacks features for protecting a motor vehicle.

U.S. Pat. No. 2,454,896, issued to Ellis Traub on Nov. 30, 1948, U.S. Pat. No. 2,658,967, issued to Arthur L. Matschke, Jr. on Nov. 10, 1953, and U.S. Pat. No. 2,879,350, issued to Clarence A. Howell on Mar. 24, 1959 show feelers for detecting a vehicle and energizing an alarm responsive thereto. Matschke's device is rubber coated to protect the finish of the motor vehicle. There is no structural integrity for resisting impact. In these three devices, the lamp is remote from the feeler.

None of the above inventions and patents, taken either singly or in combination, is seen to describe the instant invention as claimed.

SUMMARY OF THE INVENTION

The present invention provides a user friendly barrier for protecting structures which have traditionally been protected by solid barriers. The barrier accommodates incidental or light contact by a motor vehicle, and includes features designed to minimize damage to a vehicle.

The overall configuration is that of the familiar vertical pole. However, a stout spring located at the ground enables the pole to tilt without damage if contacted. This protects both the pole and the vehicle. A further feature protecting primarily the motor vehicle is the provision of flexible, resilient outer materials.

The device is reinforced by sufficiently strong inner components to provide resistance to being demolished or pushed aside. For one, the above mentioned spring is strong enough to resist breaking from its points of attachment. Also, the body of the pole has an inner metal member, such as a pipe, which resists deformation.

The device also includes warnings for apprising a driver of contact therewith. Two active alarms are provided. In response to contact, a lamp on top of the pole illuminates, and an audible alarm is also activated. Preferably, the audible alarm includes a synthesized voice advising the driver to stop or back up. An additional warning is provided by indicia disposed upon the pole. This indicia may take the form of a cautionary word, or may include readily recognizable symbols, such as striping in appropriate colors.

Where desired, the latter protection is omitted, there being commercial or other identifying indicia instead.

The novel arrangement encourages hesitant drivers to approach and maneuver with greater confidence, knowing that damage will not ensue if a slight miscalculation is made. This will encourage some people who otherwise might be intimidated to use the protected facilities. It may also hasten the necessary maneuvers of others, thus saving time for those users and those who must wait for the latter users to complete their activities or transactions.

The nature of the alarms is reassuring to drivers. An audible alarm which is not extreme in its characteristics will not induce a panic reaction in an unsure driver. The visible alarm precisely locates the object being contacted by the motor vehicle. This combination in particular, especially considering the yielding nature of the post, will mitigate excessive caution and still assist most motorists in maneuvering into place at the facility.

Accordingly, it is a principal object of the invention to provide a vertical post for protecting a delicate facility from contact with or impact from a motor vehicle.

It is another object of the invention to cause the post to yield to incidental contact with a motor vehicle.

It is a further object of the invention to provide a visual alarm warning of incidental contact with a motor vehicle.

Still another object of the invention is to provide an audible alarm warning of incidental contact with a motor vehicle.

An additional object of the invention is to avoid damage to a motor vehicle in the event of incidental contact with the post.

It is again an object of the invention to provide a self-contained electrical power source.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
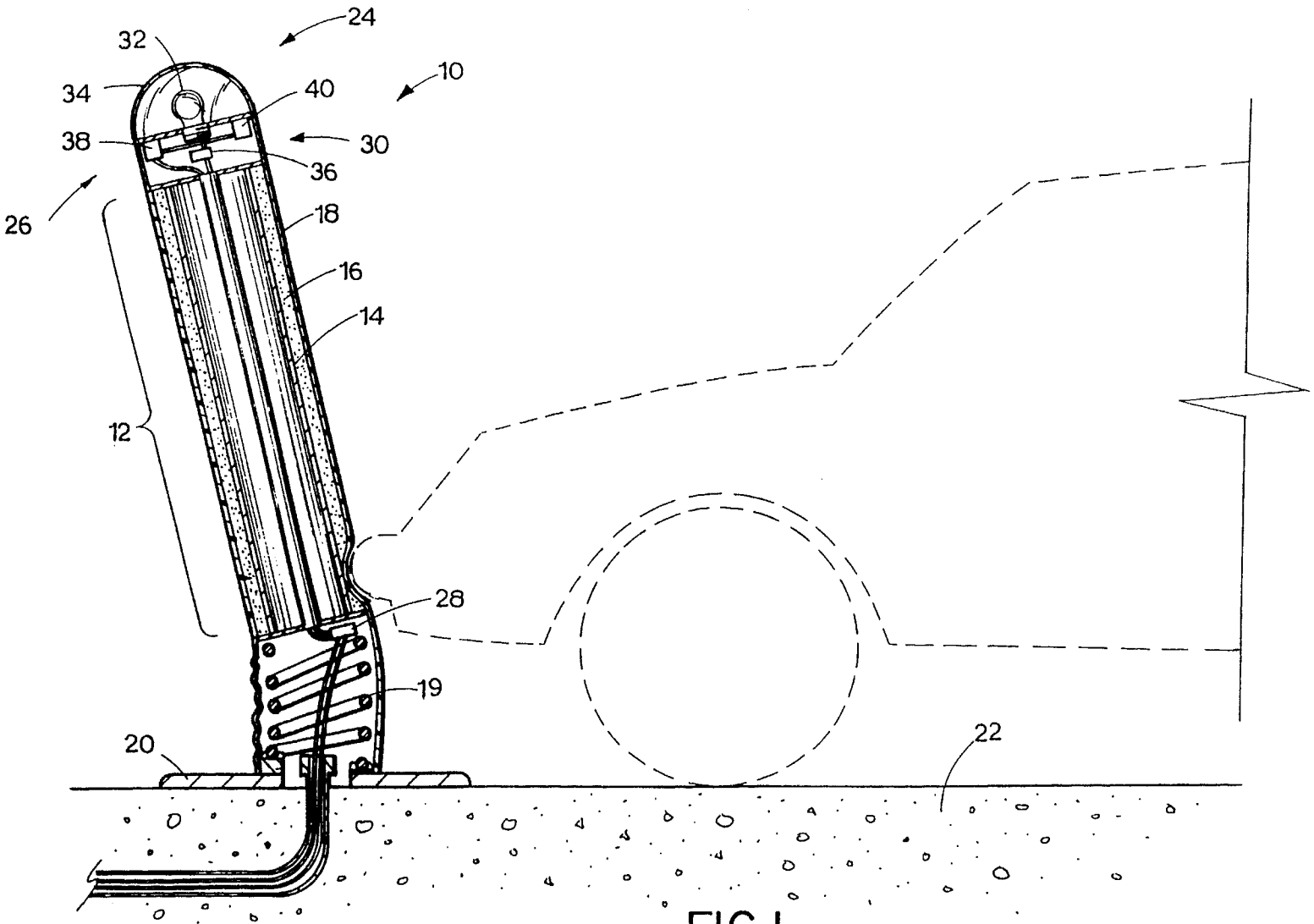
FIG. 1 is a diagrammatic, side cross sectional view of the novel protective post, illustrating contact with a motor vehicle.

FIG. 1 shows the novel protective warning post 10 being incidentally contacted by a motor vehicle. In this context, incidental contact will be understood to signify contact wherein a motor vehicle touches and moves the upper portion of post 10, continuously and at low speeds, as frequently encountered during maneuvering.

Post 10 has a body 12 including a rigid internal structural member 14, such as a suitably sized section of pipe, for maintaining the elongated and generally cylindrical outer configuration of body 12. Surrounding member 14 to the exterior is a protective resilient member 16, which may be made from foam rubber or the like. Member 14 will maintain a constant outer configuration when undisturbed, but will yield resiliently to incidental contact, as shown in the depiction of FIG. 1. Member 14 thus prevents damage to the finish of a motor vehicle. A rubber boot 18 is preferably disposed about member 16, to exclude dust, water, and similar environmental elements, while retaining the resilient characteristics of member 16.

Body 12 thus generally maintains a characteristic, predetermined configuration, despite localized and temporary deformation. This configuration is maintained in part due to the following hinging arrangement. A stout coil spring 19, of strength and elastic memory capable of withstanding incidental contact by temporarily bending but not deforming, is attached to body 12 and also to a rigid base 20. Spring 19 enables body 12 to return to its original configuration after a vehicle contacting post 10 moves out of contact therewith. Base 20 is anchored to an environmental surface, which will in most cases be concrete or asphalt 22.

Post 10 includes a visible alarm 24 and an audible alarm 26. Alarms 24 and 26 are actuated by a tilt switch 28, such as a switch making electrical contact when moved from its original orientation. Switch 28 closes electrical circuitry 30 extending from a power source (not shown) to alarms 24, 26. Electrical circuitry 30 will be understood to encompass all individual electrical conductors operably connecting the various electrical alarm components and extending to a connection (not shown) to the external power source. Visible and audible alarm elements are located atop post 10, as shown.

Visible alarm 24 comprises a lamp 32 covered by a lens 34. A flasher 36 is disposed in circuit 30 to cause lamp 32 to light intermittently.

Audible alarm 26 comprises a voice synthesizer 38 and a speaker 40. A preferred form of audible signal includes a synthetic voice message advising the driver of proximity to post 10 or to the facility protected thereby, and further advising the driver to back away therefrom. A voice message is preferred to a buzzer or siren, since it will more likely provoke an intentional response, rather than a panic response.

Figure 2:
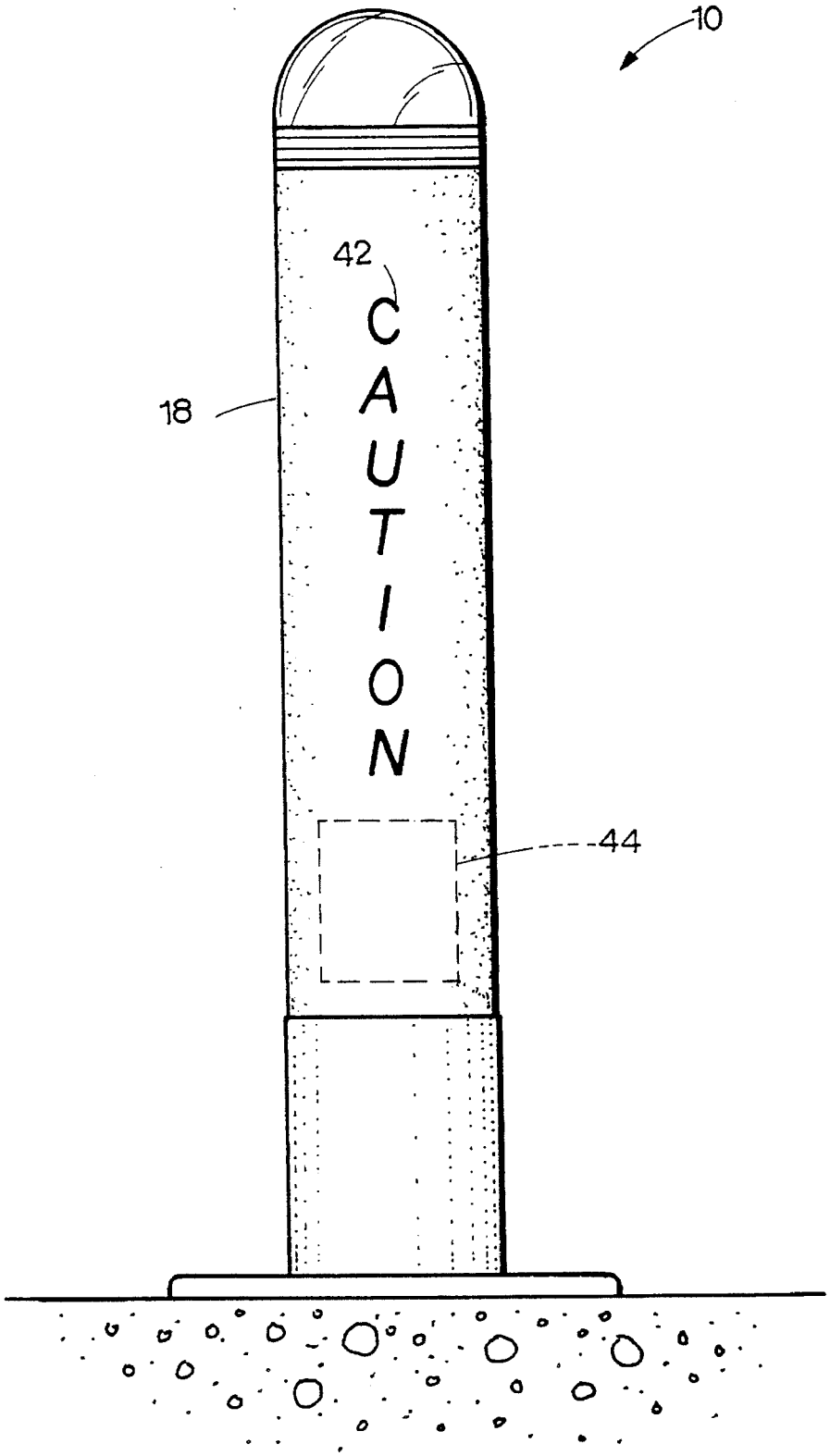
FIG. 2 is a diagrammatic, side elevational view of the post, showing an alternative embodiment of the invention, including a battery power source and indicia disposed upon the post.

Turning now to FIG. 2, an alternative embodiment of the invention is shown. In this embodiment, indicia 42 is located on the exterior of boot 18. This indicia 42 may be cautionary or warning in nature, as shown, or may be related to the identity of the owner of the protected facility.

In contrast to the embodiment of FIG. 1, wherein electrical circuitry 30 is connected to AC power from an electrical utility, post 10 may have a battery power source 44 contained integrally therewith. Battery power source 44 is located at any convenient, protected location, in this case within structural member 14.

It is to be understood that the present invention is not limited to the embodiments described above, but encompasses any and all embodiments within the scope of the following claims.

I claim:

1. A protective warning post comprising:

a base mountable to a surface;

an elongated body having a rigid internal structural member and a protective resilient member surrounding said internal structural member;

hinge means for yieldingly attaching said body to said base; and a visible alarm comprising electrical circuitry for connection to a power source said electrical circuitry including a flasher, a lamp disposed atop said body, a lens covering said lamp, and means for actuating said alarm, whereby upon incidental contact by a motor vehicle with the post said protective resilient member prevents damage to the motor vehicle; said rigid internal structure retains its configuration and pivots about said base on said hinge means, whereupon actuation of said visible alarm causes said lamp to light intermittently; and said hinge means returns said body to its original orientation upon removal of the contact by the motor vehicle.

2. The protective warning post according to claim 1, further comprising an audible alarm connected to said electrical circuitry, and including a speaker and a voice synthesizer operably connected to said speaker.

3. The protective warning post according to claim 1, further comprising warning indicia exteriorly and visibly disposed thereon.

4. The protective warning post according to claim 1, further comprising a battery connected to said electrical circuitry.

5. The protective warning post according to claim 1, said hinge means comprising a coil spring.

6. A protective warning post comprising:

a base mountable to a surface;

an elongated body having a rigid internal structural member and a protective resilient member surrounding said internal structural member;

hinge means for yieldingly attaching said body to said base; and an audible alarm including electrical circuitry for connection to a power source and means for actuating said alarm responsive to incidental contact by a motor vehicle with said post; whereby upon incidental contact by a motor vehicle with the post said protective resilient member prevents damage to the motor vehicle; said rigid internal structure retains its configuration and pivots about said base on said hinge means, whereupon actuation of said audible alarm causes said alarm to sound; and said hinge means returns said body to its original orientation upon removal of the contact by the motor vehicle.

* * * * *